US006811434B2

(12) United States Patent
Wu

(10) Patent No.: US 6,811,434 B2
(45) Date of Patent: Nov. 2, 2004

(54) STACKED ELECTRICAL CONNECTOR

(75) Inventor: Jerry Wu, Irvine, CA (US)

(73) Assignee: Hon Hai Precision Ind. CO., LTD, Taipei Hsien (TW)

( * ) Notice: Subject to any disclaimer, the term of this patent is extended or adjusted under 35 U.S.C. 154(b) by 0 days.

(21) Appl. No.: 10/295,737

(22) Filed: Nov. 15, 2002

(65) Prior Publication Data

US 2003/0224653 A1 Dec. 4, 2003

Related U.S. Application Data

(63) Continuation-in-part of application No. 10/159,458, filed on May 31, 2002, now Pat. No. 6,589,077.

(51) Int. Cl.[7] ..... H01R 13/60; H01R 13/66
(52) U.S. Cl. ..... 439/567; 439/541.5
(58) Field of Search ..... 439/541.5, 79

(56) References Cited

U.S. PATENT DOCUMENTS 4,802,860 A * 2/1989 Kikuta ..... 439/79
5,213,515 A * 5/1993 Ishikawa et al. ..... 439/79
5,346,404 A * 9/1994 Shimada ..... 439/108
5,354,207 A * 10/1994 Chikano ..... 439/79
5,688,129 A * 11/1997 Flaherty ..... 439/79
6,053,773 A * 4/2000 Wu ..... 439/609
6,183,270 B1 * 2/2001 Huang et al. ..... 439/79
6,524,130 B1 * 2/2003 Yeh ..... 439/541.5

* cited by examiner

*Primary Examiner*—Hae Moon Hyeon
(74) *Attorney, Agent, or Firm*—Wei Te Chung

(57) ABSTRACT

An electrical connector (1) includes an insulative housing (2), a number of terminals (3, 4), a rear spacer (5) and a board lock (6) assembled to the insulative housing for securing the electrical connector to a PCB. The insulative housing defines a number of passageways (200) therethrough and a number of apertures (250) communicating with corresponding passageways. The terminals each include a mounting portion (30, 40) received in a corresponding passageway and a contacting portion (31, 41) received in a corresponding aperture. The rear spacer is assembled to the insulative housing and defining a number of positioning grooves (500) for positioning corresponding upper terminals.

10 Claims, 10 Drawing Sheets

STACKED ELECTRICAL CONNECTOR

CROSS-REFERENCE TO RELATED APPLICATIONS

This patent application is a continuation-in-part of U.S. patent application Ser. No. 10/159,458 filed on May 31, 2002 now U.S. Pat. No. 6,589,077.

BACKGROUND OF THE INVENTION

1. Field of the Invention

The present invention relates to an electrical connector, and particularly to a stacked electrical connector having a true position of upper terminals.

2. Description of Prior Art

An organization, named Serial Advanced Technology Attachment (SATA) Working Group released a specification defining the SATA interface. The interface is used to connect storage devices such as hard disk, DVD and CD-ROM drives to a PC motherboard. The specification defines a first type SATA connector connected with a cable and a second type SATA connector mounted on a printed circuit board (PCB).

The second type SATA connector defined by the specification includes an insulative housing and a plurality of contacts. The contacts are retained in the housing and partly extend out of the housing for electrically connecting with the PCB. For simplifying the mounting process of the SATA connector to the PCB, the SATA connector is provided with press-fit contacts which have needle-eyed tails for being forcibly fitted into metal plated through holes of the PCB.

As demand of large the second type SATA connectors become popular for interconnecting storage device to a mother PCB. A pair of SATA connectors is often mounted on a mother PCB for connecting the mother PCB with a pair of storage device. In convention, the SATA connectors are designed side by side. However, as the size of the mother PCB is reduced for developing science, less space is provided on the mother PCB to receive the SATA.

Hence, an improved electrical connector adapted for connecting with a multiple of storage devices is required to overcome the disadvantages of the conventional electrical connector.

SUMMARY OF THE INVENTION

Accordingly, one object of the present invention is to provide an electrical connector adapted for connecting with a multiple of storage devices with less occupied space on a mother PCB.

The other object of the present invention is to provide a stacked electrical connector having a true position of upper terminals.

In order to achieve the objects above-mentioned, a stacked electrical connector comprises an insulative housing, a plurality of upper and lower terminals received in the insulative housing, a rear spacer and a pair of board locks. The insulative housing comprises a crossbeam and a pair of tongue plates extending forwardly from the crossbeam. The crossbeam defines a plurality of passageways therethrough and a plurality of receiving cavities at a rear surface thereof. The tongue plates each define a plurality of apertures in communication with corresponding passageways. In addition, the insulative housing defines a pair of guiding recesses at a bottom end thereof. The upper and lower terminals each comprises a mounting portion received in a corresponding passageway, a contacting portion extending forwardly from the mounting portion and a slanted tail extending downwardly from the mounting portion. The contacting portions are received in the apertures, respectively. The rear spacer is assembled to the insulative housing and comprises a slanted base plate. The base plate defines a plurality of position grooves for positioning corresponding upper terminals.

Other objects, advantages and novel features of the invention will become more apparent from the following detailed description when taken in conjunction with the accompanying drawings.

DETAILED DESCRIPTION OF THE INVENTION

Figure 1:
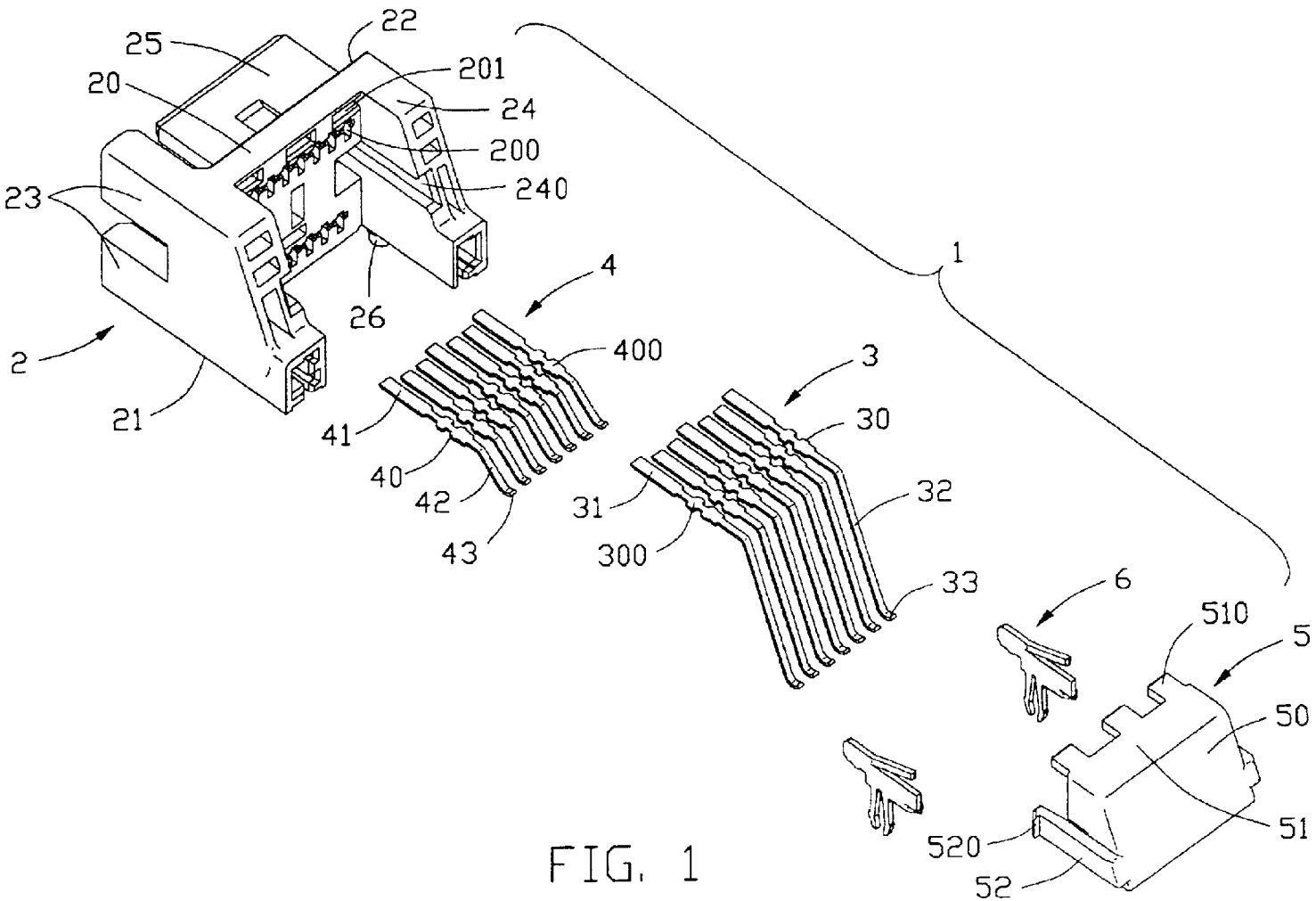
FIG. 1 is an exploded, perspective top view of an electrical connector in accordance with the present invention.

Reference will now be made to the drawing figures to describe the present invention in detail.

Figure 2:
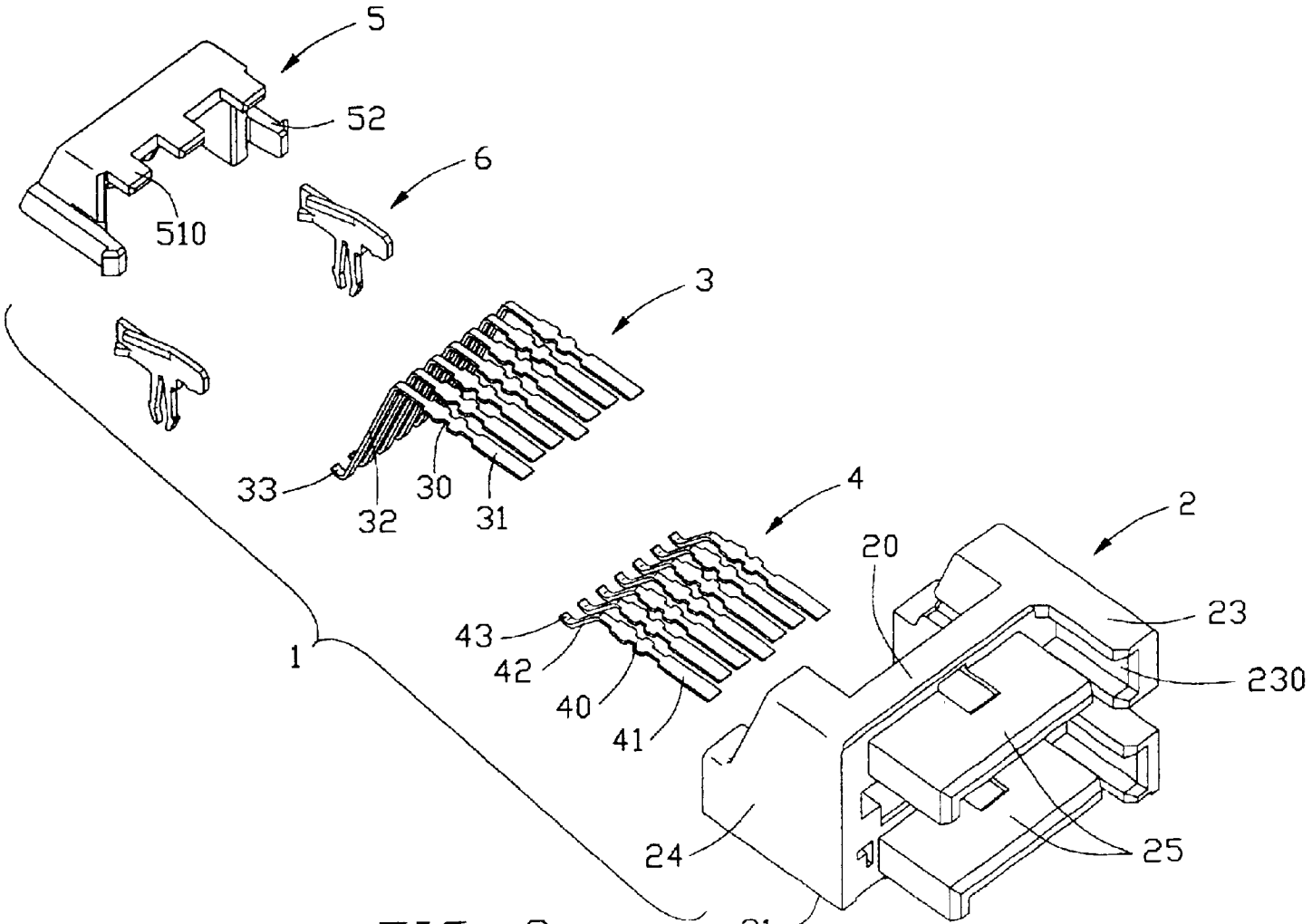
FIG. 2 is a view similar to FIG. 1 from a different aspect.
Figure 3:
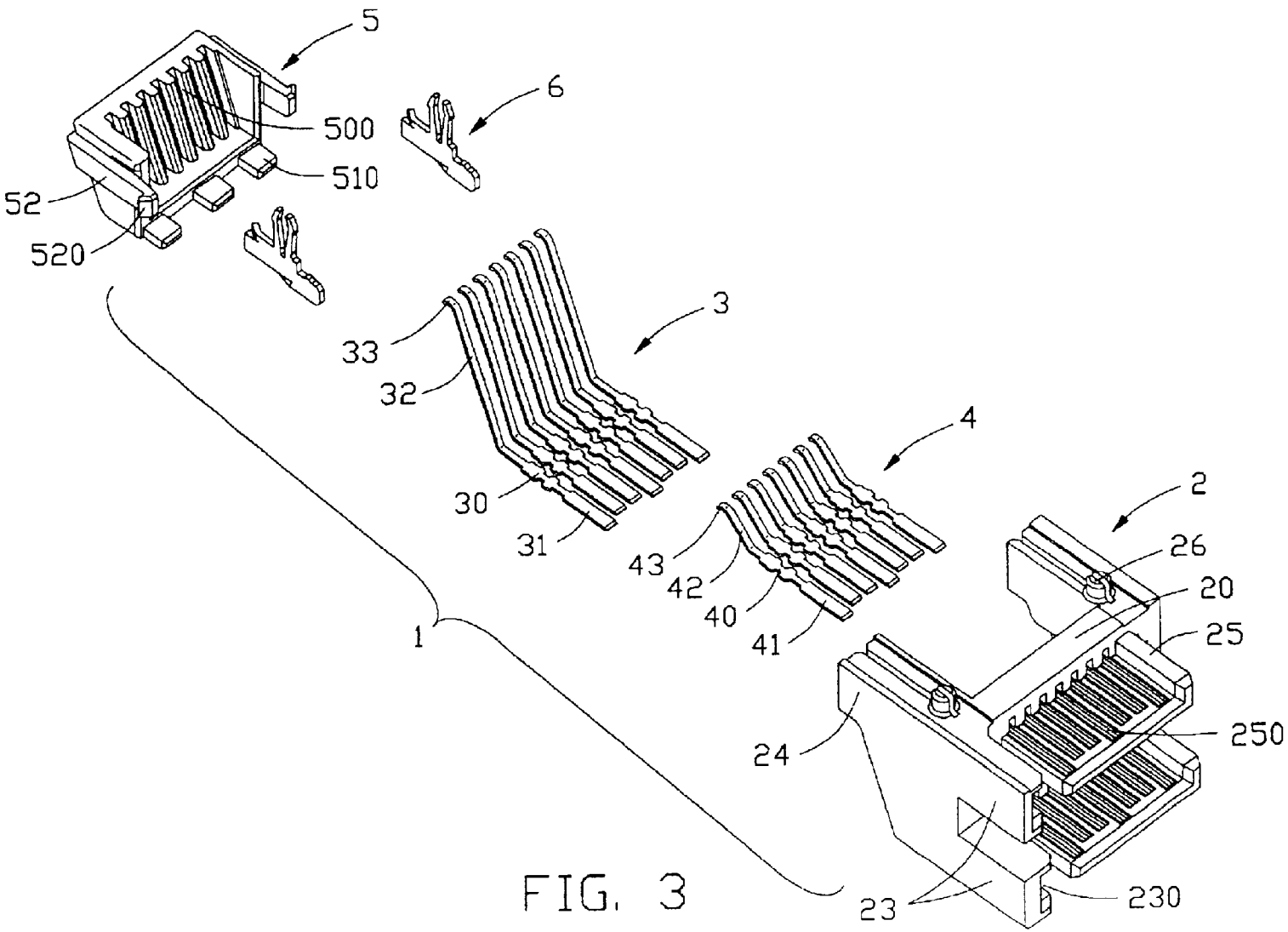
FIG. 3 is an exploded, perspective bottom view of the electrical connector in FIG. 1.

Referring to FIGS. 1–3, an electrical connector 1, such as a stacked serial ATA connector 1, in accordance with the present invention comprises an insulative housing 2, a plurality of upper and lower terminals 3, 4 received in the insulative housing 2, a rear spacer 5 assembled to the insulative housing 2 and a pair of board locks 6 assembled to the insulative housing 2.

The insulative housing 2 defines a bottom mounting surface 21 for mounting onto a PCB (not shown) and a front mating surface 22 for engaging with a mating receptacle connector (not shown). The insulative housing 2 comprises a cross beam 20, a pair of upper and lower bars 23 extending forwardly from the front mating surface 22, a pair of sidewalls 24 extending rearwardly from transverse ends of the crossbeam 20. A pair of upper and lower tongue plates 25 extends forwardly from the mating surface 22. The crossbeam 20 defines a plurality of longitudinal passageways 200 therethrough and three receiving cavities 201 at a rear surface thereof. The longitudinal passageways 200 are arranged in a upper and a lower rows. The upper and lower tongue plates 25 each define a plurality of longitudinal apertures 250 on a bottom surface thereof, each communicating with a corresponding passageway 200 in the crossbeam 20. Each of the bars 23 defines a channel 230 on an inner surface thereof for receiving a guiding beam of a mating receptacle connector (not shown). The sidewalls 24 each define a guiding recess 240 on an inner surface thereof. A step 242 is further provided behind the guiding recess 240. A pair of guiding posts 26 extends downwardly from a bottom surface of the sidewalls 24.

The upper and lower terminals 3 (4) include a plurality of long grounding terminals and short signal terminals, respectively. Each of the upper (lower) terminals 3 (4) comprises a mounting portion 30 (40), a contacting portion 31 (41)

extending forwardly from a front end of the mounting portion 30 (40), a slanted tail 32 (42) extending rearwardly and downwardly from a rear end of the mounting portion 30 (40) and a horizontal soldering portion 33 (43) extending rearwardly from a bottom end of the slanted tail 32 (42). It should be noted that the mounting portion 30 and the slanted tail 32 of the upper terminal 3 are longer than those of the lower terminal 4. The contacting portion 31 and the soldering portion 33 of the upper terminal 3 substantially equal to those of the lower terminal 4.

The rear spacer 5 comprises a slanted base plate 50, a top cover 51 extending forwardly from a top end of the base plate 50 and a pair of opposite resilient arm 52 extending forwardly from a bottom end of the base plate 50. The base plate 50 defines a plurality of positioning grooves 500 on a front surface thereof for receiving corresponding slanted tails 32 of the upper terminals 3. The top cover 51 comprises three retention plates 510 extending forwardly from a front end thereof. The resilient arms 52 each comprise a hook 520 extending outwardly from a front end thereof.

Figure 4:
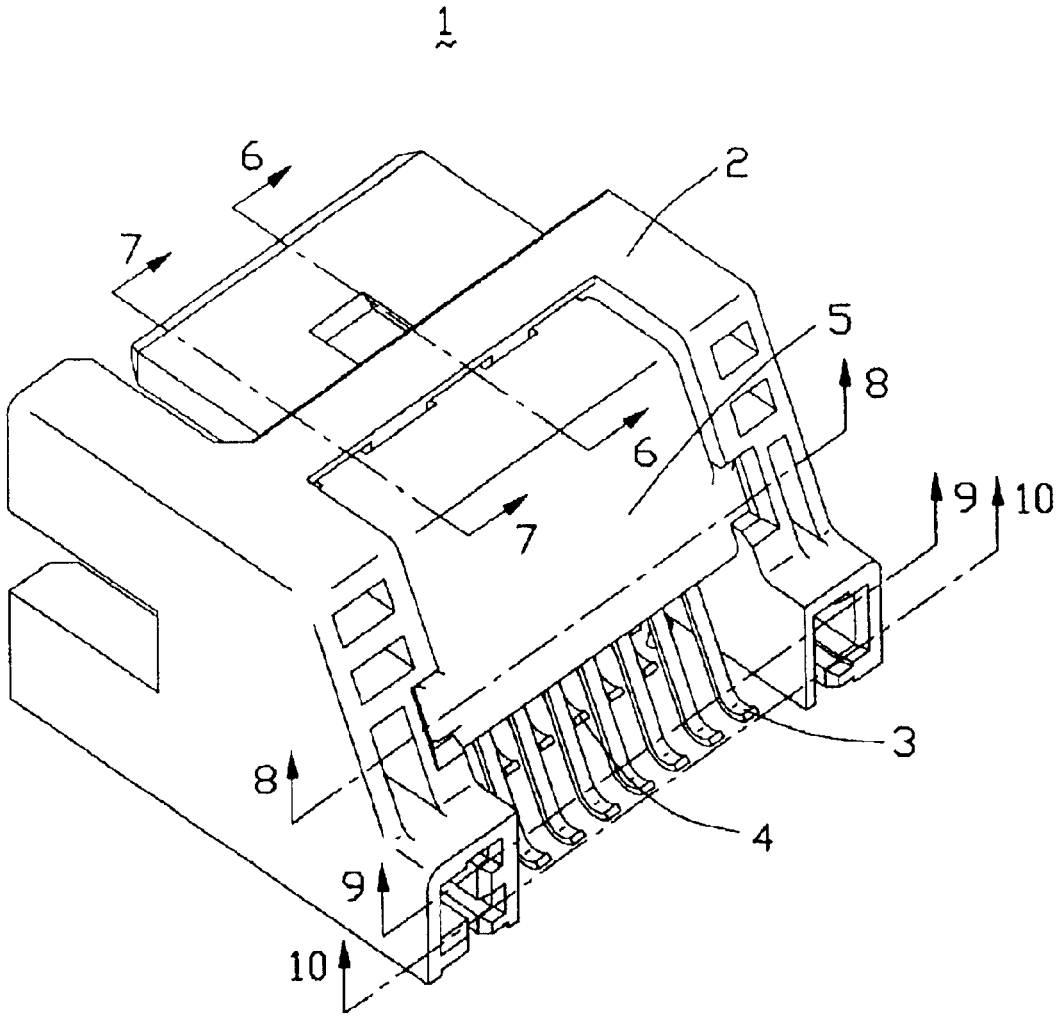
FIG. 4 is an assembled view of FIG. 1.
Figure 5:
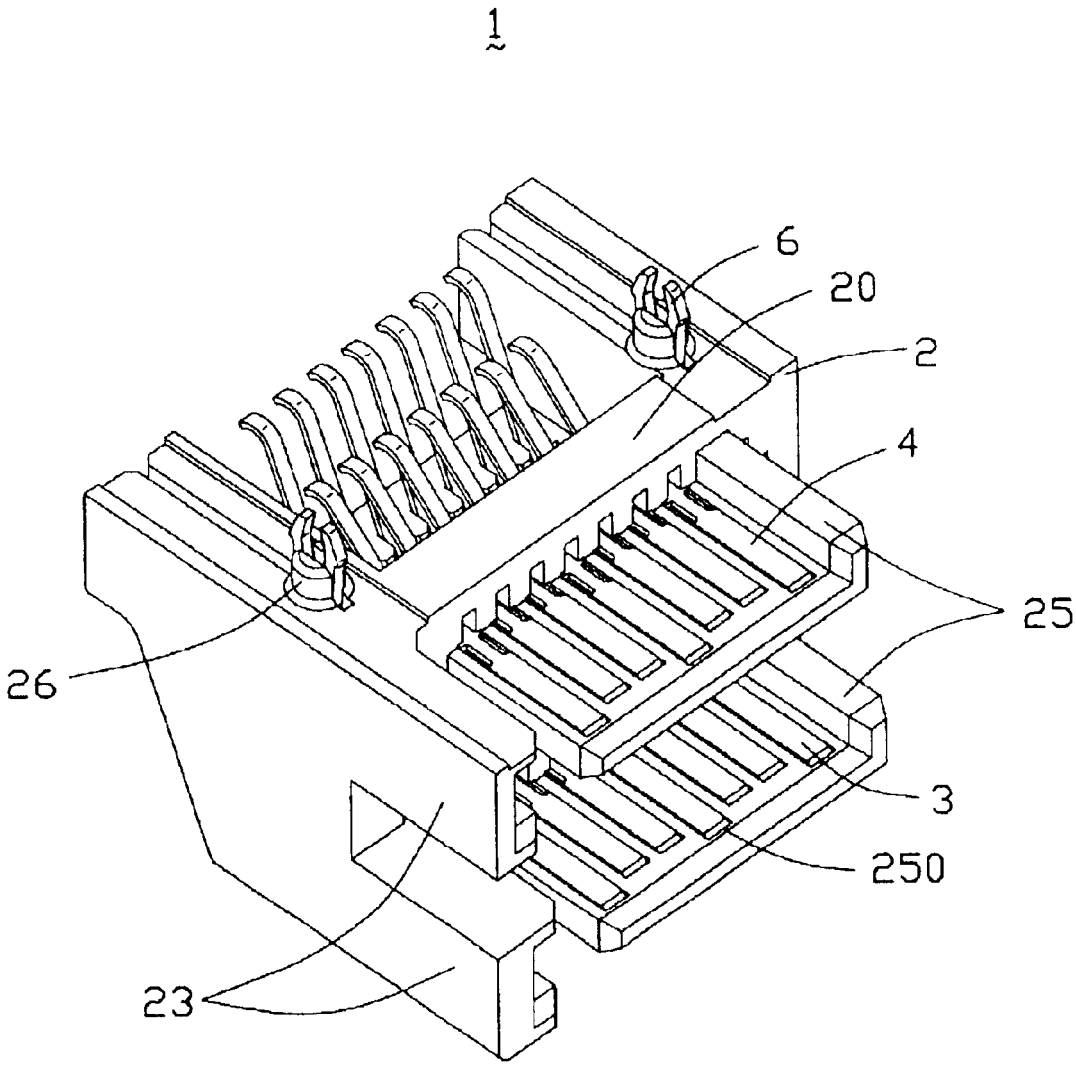
FIG. 5 is an assembled view of FIG. 3.

FIGS. 4 and 5 show an assembled electrical connector 1 of the present invention. In assembly, at first, the upper and lower terminals 3 (4) are assembled to the insulative housing 2 from a back-to-front direction with the mounting portions 30 (40) received in corresponding passageways 200 of the crossbeam 20 and the contacting portions 31 (40) received in corresponding apertures 250 of the upper and lower tongue plates 25. The mounting portions 30 (40) have an interferential engagement with the crossbeam 20 thereby securing the terminals 3 (4) to the insulative housing 2. The soldering portions 33 (43) of the upper and lower terminals 3 (4) are substantially positioned on a horizontal plane for soldering on the PCB.

Figure 6:
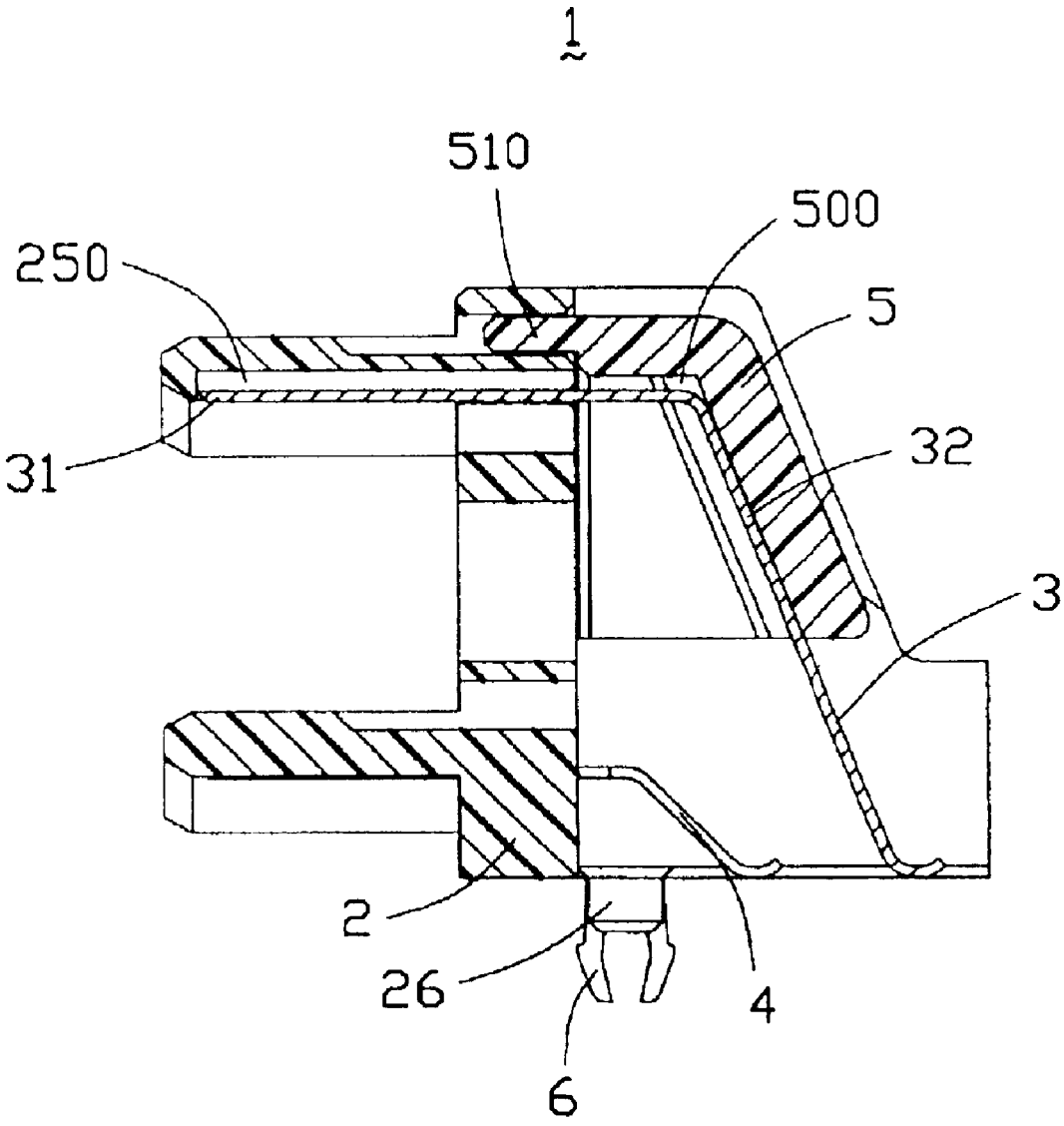
FIG. 6 is a cross-sectional view taken along line 6—6 of FIG. 4.
Figure 7:
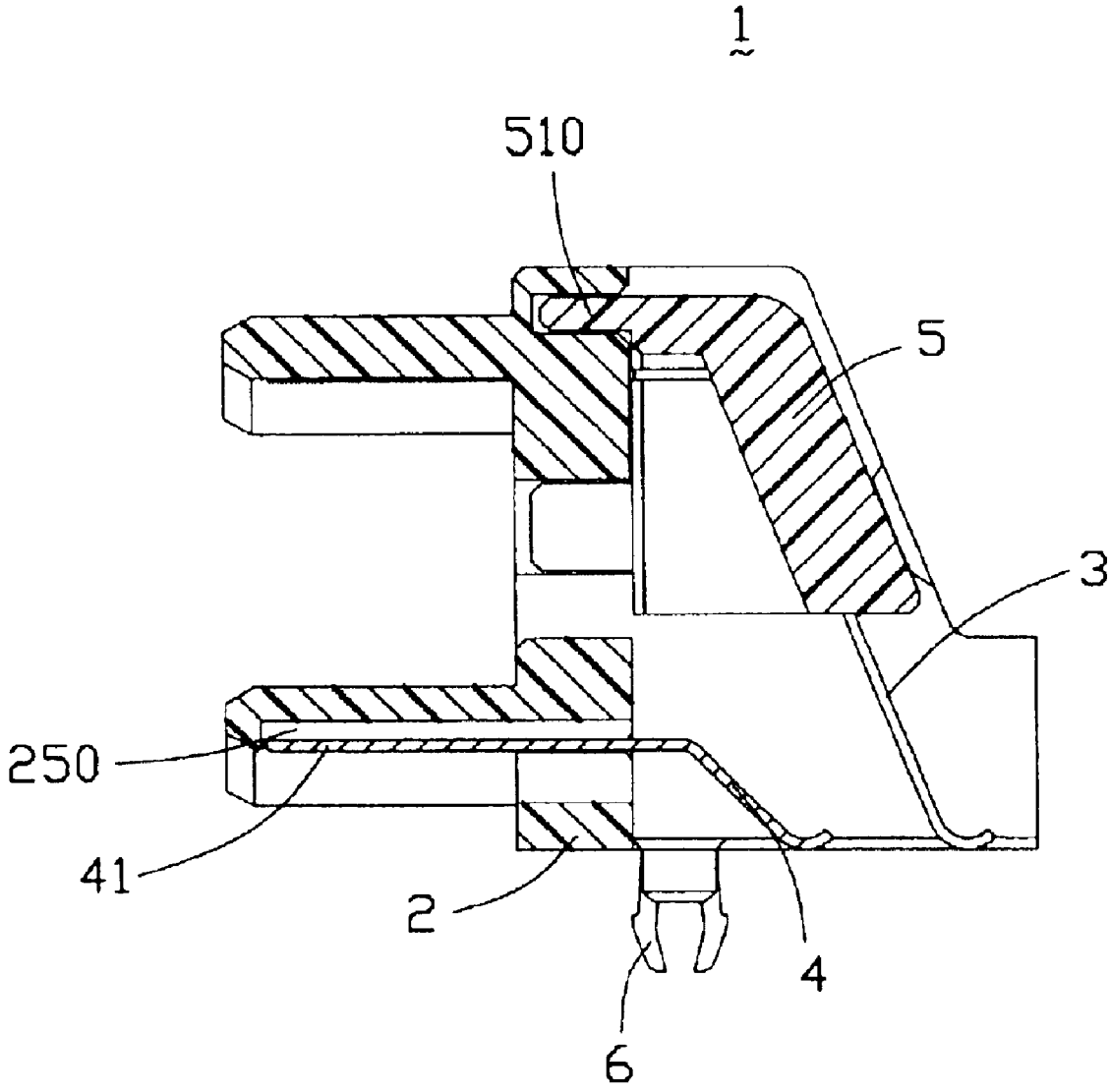
FIG. 7 is a cross-sectional view taken along line 7—7 of FIG. 4.
Figure 8:
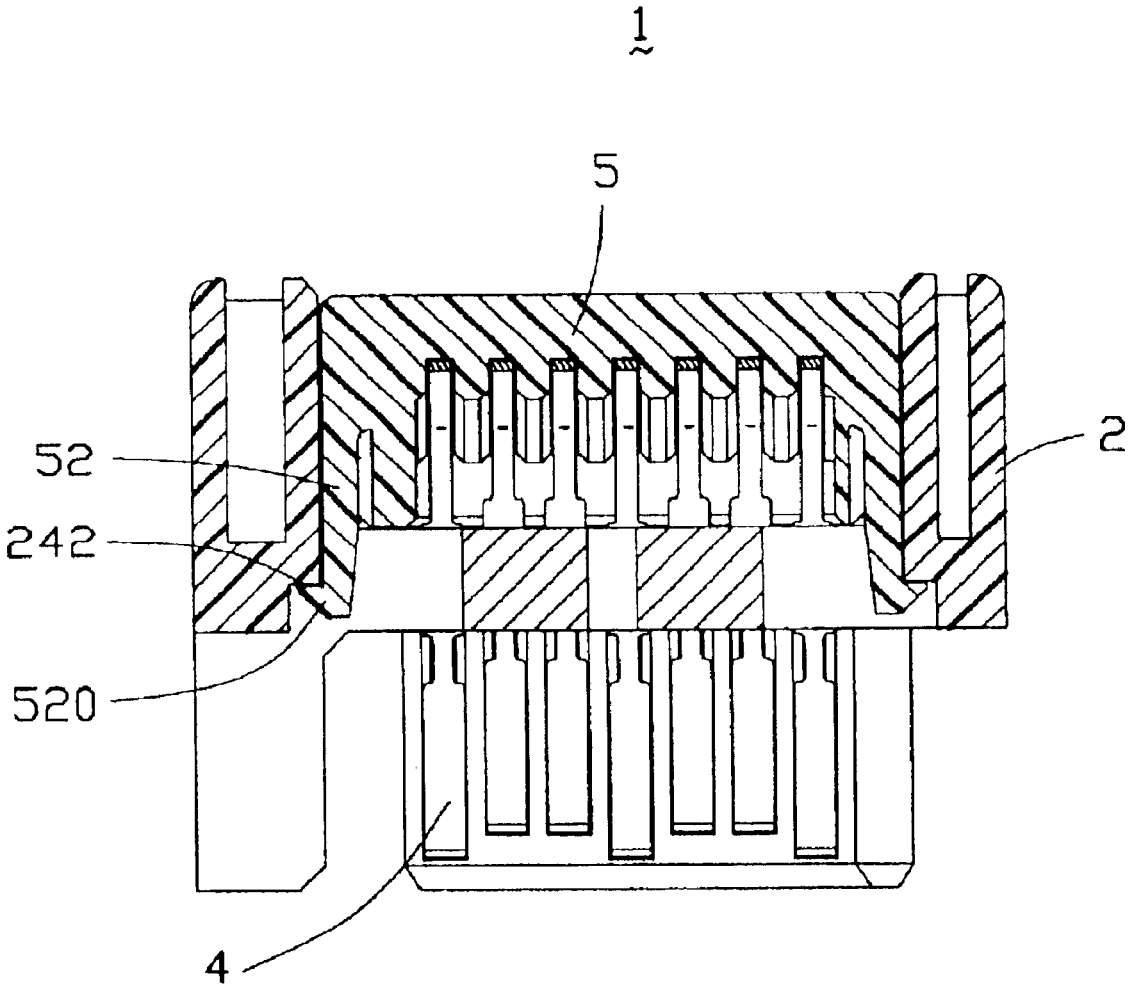
FIG. 8 is a cross-sectional view taken along line 8—8 of FIG. 4.
Figure 9:
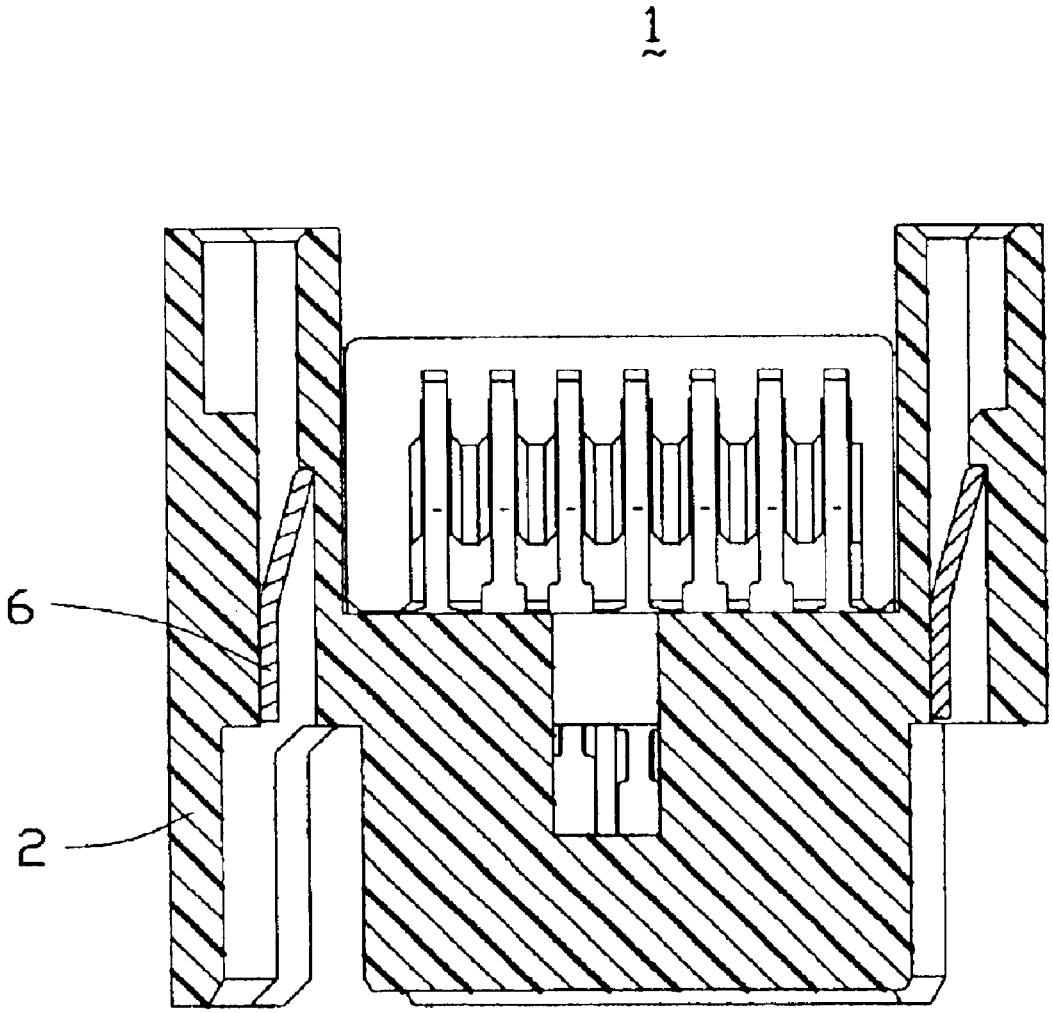
FIG. 9 is a cross-sectional view taken along line 9—9 of FIG. 4.
Figure 10:
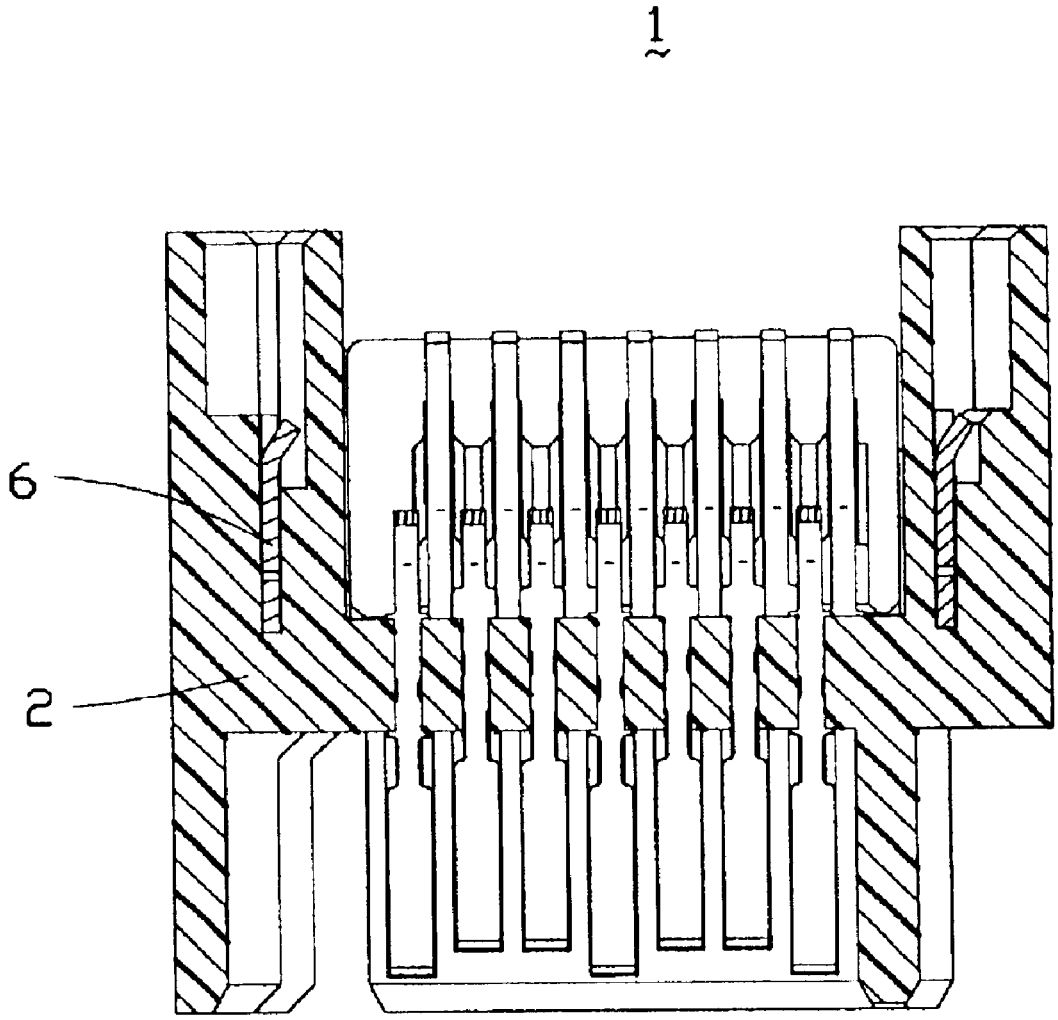
FIG. 10 is a cross-sectional view taken along line 10—10 of FIG. 4.

Successively, the spacer 5 is assembled to the insulative housing 2 from a rear end thereof. In conjunction with FIGS. 6–7, The retention plates 510 of the spacer 5 are received in corresponding receiving cavities 201 of the insulative housing 2. The slanted tails 32 of the upper terminals 3 are received in corresponding positioning grooves 500 of the base plate 50. Referring to FIG. 8, the resilient arms 52 of the spacer 5 are received in corresponding guiding recesses 240 of the sidewalls 24. The hooks 520 of the resilient arms 52 engage with corresponding steps 242 of the sidewalls 24.

Finally, the board locks 6 are assembled to the insulative housing 2 from a back-to-front direction. In conjunction with FIGS. 1–3 and 9–10, the related description of the board locks 6, the related structure of the insulative housing 2 and the engagement between the board locks 6 and the insulative housing 2 are disclosed in patent application Ser. No. 10/159,458, filed on Apr. 31, 2002, and entitled "ELECTRICAL CONNECTOR WITH SELF-RETAINING BOARD LOCKS". The disclosures of the '458 application are wholly incorporated herein by reference.

During the assembly of the electrical connector 1 to the PCB, the posts 26 engage in holes defined by the PCB thereby achieving an accurate position of the electrical connector 1 on the PCB. The board locks 6 engage with the PCB for securely mounting the electrical connector 1 on the PCB.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked electrical connector comprising:

an insulative housing comprising a crossbeam, and an upper and a lower tongue plates extending forwardly from the crossbeam, the crossbeam defining a plurality of passageways and the upper and the lower tongue plates each defining a plurality of apertures in communication with corresponding passageways;

a plurality of upper and lower terminals each comprising a mounting portion received in a corresponding passageway, a contacting portion received in a corresponding aperture and a tail portion extending from the mounting portion and exposed beyond the insulative housing, the tail portions of the upper and the lower terminals arranged in two rows along a front-to-back direction of the insulative housing; and a spacer being assembled to the insulative housing in a back-to-front direction of the insulative housing and defining a plurality of positioning grooves to respectively receive the tail portions of the upper terminals for positioning corresponding upper terminals.

2. The electrical connector as described in claim 1, wherein the spacer comprises a slanted base plate which defines a plurality of positioning grooves for receiving corresponding slanted tails extending from the mounting portions of the upper terminals, respectively.

3. The electrical connector as described in claim 1, wherein the spacer forms a retention plate at a front end thereof and the cross beam defines a receiving cavity for receiving the retention plate.

4. The electrical connector as described in claim 1, wherein the spacer forms a resilient arm at a bottom end thereof and the insulative housing defining a guiding recess for receiving the resilient arm.

5. The electrical connector as described in claim 1, wherein the resilient arms each form a hook at a free end thereof for engaging with a step formed behind the guiding recess in the insulative housing.

6. The electrical connector as described in claim 1 further comprising a board lock assembled to the insulative housing for securing the electrical connector to a printed circuit board (PCB).

7. A stacked connector assembly comprising:

an insulative housing comprising a crossbeam, upper and lower mating ports extending forwardly from the crossbeam and a pair of sidewalls extending rearwardly from the crossbeam, the crossbeam forming an upper and a lower bars extending forwardly therefrom and respectively located beside the upper and the lower mating ports;

a plurality of terminals respectively disposed in said upper and lower mating ports;

a spacer for aligning tails of the terminals of the upper mating port, being forwardly assembled to the housing from a rear face of the housing; and interlocking means formed on the housing between said upper and lower mating ports to engage hooks on the spacer.

8. The assembly as described in claim 7, wherein interengaging means is formed on an upper portion of the housing and an upper portion of the spacer for restricting relative movement between the spacer and the housing except along a front-to-back direction.

9. The electrical connector as described in claim 1, wherein the insulative housing further forms an upper and a lower bars extending forwardly from the crossbeam and respectively located beside the upper and the lower tongue plates.

10. The electrical connector as described in claim 9, wherein the upper and the lower bars each defines a channel on an inner surface thereof.

* * * * *